US007331129B1

(12) United States Patent
Chapman et al.

(10) Patent No.: US 7,331,129 B1
(45) Date of Patent: Feb. 19, 2008

(54) SNOWSHOE FRAME WITH VARIED CROSS SECTION

(75) Inventors: Peter W. Chapman, Oakland, CA (US); Daniel T. Emerson, Berkeley, CA (US)

(73) Assignee: KZ Snowshoes, Inc., Carlsbad, CA (US)

( * ) Notice: Subject to any disclaimer, the term of this patent is extended or adjusted under 35 U.S.C. 154(b) by 345 days.

(21) Appl. No.: 11/207,693

(22) Filed: Aug. 18, 2005

(51) Int. Cl.
*A43B 5/04* (2006.01)

(52) U.S. Cl. ..... 36/122

(58) Field of Classification Search ..... 36/122–125
See application file for complete search history.

(56) References Cited

U.S. PATENT DOCUMENTS

| | | | | | |
|---|---|---|---|---|---|
| 1,572,200 | A | * | 2/1926 | Fox | 36/122 |
| 3,636,643 | A | * | 1/1972 | Lundquist | 36/123 |
| 4,348,823 | A | * | 9/1982 | Knapp et al. | 36/123 |
| 4,720,927 | A | * | 1/1988 | Abegg | 36/122 |
| 5,440,827 | A | | 8/1995 | Klebahn et al. | |
| 5,687,491 | A | | 11/1997 | Klebahn | |
| 5,699,630 | A | | 12/1997 | Klebahn et al. | |
| 5,809,668 | A | * | 9/1998 | Kiniry et al. | 36/122 |
| 5,901,471 | A | | 5/1999 | Warner | |
| 5,966,844 | A | * | 10/1999 | Hellerman et al. | 36/122 |
| 6,185,846 | B1 | * | 2/2001 | Neidhardt, Jr. | 36/124 |
| 6,374,518 | B2 | | 4/2002 | Warner | |
| 6,401,310 | B1 | | 6/2002 | Warner et al. | |
| 6,505,423 | B1 | | 1/2003 | Klebahn et al. | |
| 6,526,629 | B1 | | 3/2003 | Warner et al. | |
| 6,725,576 | B2 | | 4/2004 | Emerson et al. | |

* cited by examiner

*Primary Examiner*—Marie Patterson
(74) *Attorney, Agent, or Firm*—Thomas M. Freiburger

(57) ABSTRACT

A snowshoe of the type with a peripheral frame formed of metal tubing and a stretched and suspended deck connected to the frame has different regions of the frame partially flattened into an approximate elliptical cross section, the major dimensions of the ellipses being in different planes in different regions of the frame. Most of the nose loop at the front end of the snowshoe frame is elongated in cross section within the plane of the nose loop, while the sides of the frame, aft of the binding suspension, may be elongated in a generally vertical plane. The orientation of these elongated cross sections in specific regions affords more strength to the frame where needed, enabling the frame to be produced of lighter material. In addition, selected local regions of the frame can be swaged to form recesses at desired sides of the frame to receive and hold the binding suspension bands or deck connecting material that wraps over the frame. Preferably the frame is formed of malleable but heat-treatable metal such as aluminum 7075 or 6061.

17 Claims, 2 Drawing Sheets

SNOWSHOE FRAME WITH VARIED CROSS SECTION

BACKGROUND OF THE INVENTION

This invention concerns snowshoes of the type having a peripheral tubular frame suspending a flexible deck. Specifically the invention concerns such a snowshoe frame having added strength in certain regions to resist forces tending to deform the shape of the frame.

Snowshoes of the general type with which this invention is concerned are shown in Atlas Snowshoe Company U.S. Pat. Nos. 5,440,827, 5,687,491, 5,699,630, 5,901,471, 6,374,518, 6,401,310, 6,505,423, 6,526,629 and 6,725,576. These patents show a peripheral frame of tubular metal, usually aluminum, with cylindrical cross section, bent and formed into the desired configuration and usually welded together at the tail end, but sometimes connected instead by a separate tail member that engages with the tube tail ends of the tubular frame (as in U.S. Pat. No. 6,725,576). In this type of snowshoe, a flexible deck membrane is supported in considerable tension from the frame, by a series of connection points at which the deck membrane loops over the frame or another piece of material extends over the frame and is secured, as by rivets, to the deck membrane.

In addition, in typical snowshoes of the above patents, the binding and the front cleat are secured to the snowshoe frame by tension bands that orient the binding and cleat in an obliquely angled toe-down position relative to the snowshoe frame. These tension bands exhibit considerable inward pulling force on the frame, with the frame supplying a strong spring force pulling outwardly on the tension bands (which are substantially inelastic). As this strong spring force is needed to maintain proper suspension of the front cleat and boot binding, the frame needs to be provided with sufficient strength, particularly in the nose loop of the frame, which is just forward of the point of tension band suspension on the frame. Otherwise the nose loop of the frame will too readily give and allow the frame to pull inwardly at the binding support points so that the binding suspension will not function properly.

It is an object of the invention to provide for increased strength in certain areas of the snowshoe frame, particularly the nose loop, without requiring heavier gauge or larger-diameter tubing.

SUMMARY OF THE INVENTION

A snowshoe of the invention has a peripheral tubing frame with a flexible deck suspended from and tensioned on the peripheral frame. The tubing of the frame is nominally circular in cross section but partially flattened in at least one region of the frame in such a way as to increase bending strength of the frame to resist deformation of the frame from forces acting on the frame during use of the snowshoe. Although the frame preferably is of bent and formed metal tubing, the tubing could be of a reinforced plastic material (such as FRP or graphite fiber-reinforced plastic), molded or shaped to the desired cross sections in the desired areas.

In a preferred form the snowshoe frame is partially flattened or ovalized in the nose loop region of the frame, the elongation of the cross section of the frame being generally in the plane of the nose loop region, such that the frame is afforded added strength against inward flexing of the frame near the aft end of the nose loop, where binding support bands may be attached.

The desired elongated cross section can be produced in a disc with hydraulic pressure applied externally, or by hydroforming, by which hydraulic force is applied from inside the tubing to form the tubing against a die applied from outside. Preferably a malleable metal (such as aluminum 7075 or 6061) is used for the tubing, and heat treated after forming.

Thus, a principal object of the invention is to form a tubular metal snowshoe frame with partially flattened areas where increased strength is needed in certain planes, especially in the nose loop, providing increased resistance against deformation where the binding can be suspended. These and other objects, advantages and features of the invention will be apparent from the following description of a preferred embodiments, considered along with the accompanying drawings.

DESCRIPTION OF PREFERRED EMBODIMENTS

Figure 1:
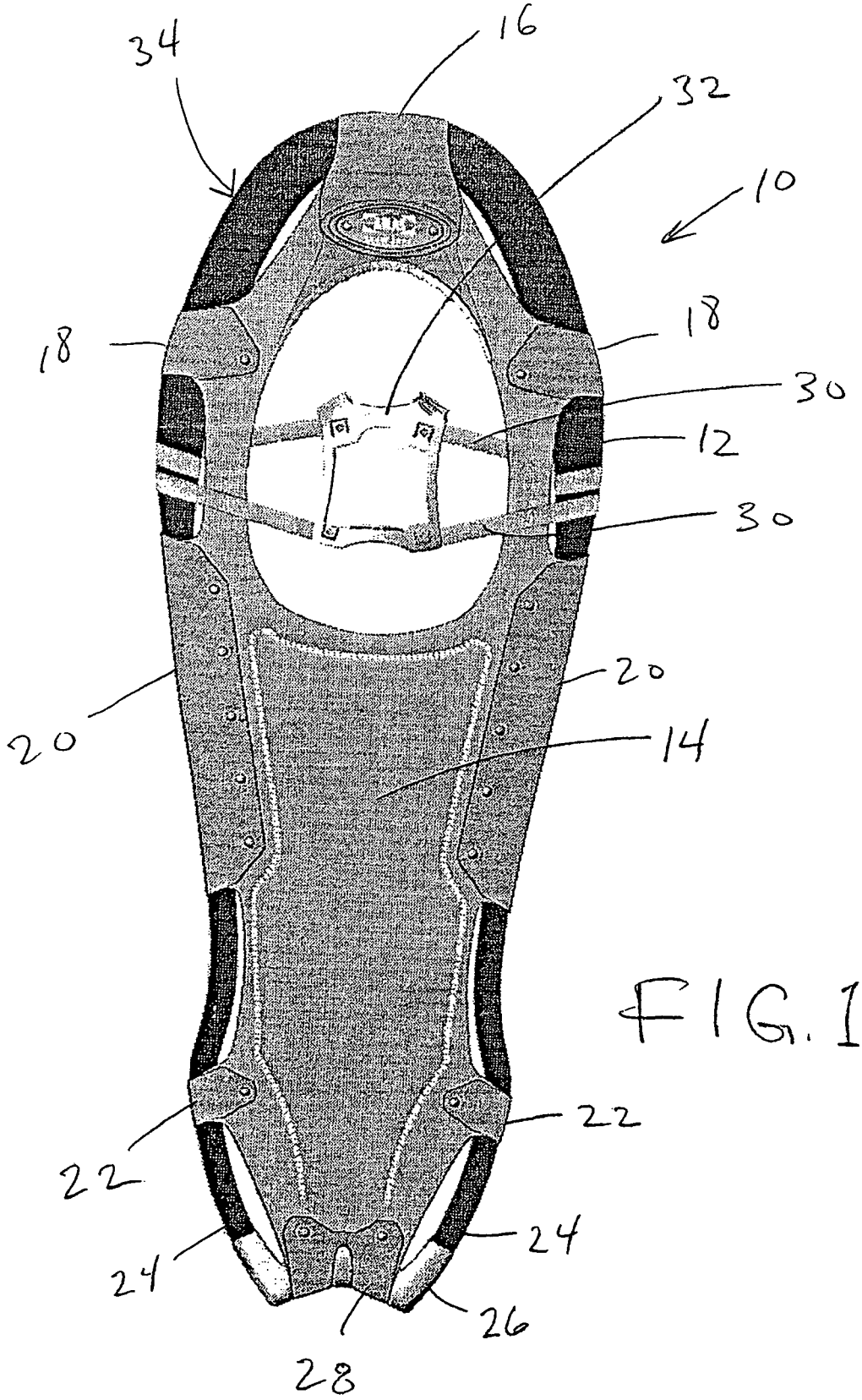
FIG. 1 is a plan view of a snowshoe in one embodiment of the invention.

FIG. 1 shows a snowshoe 10 of the type with which the invention is concerned, having a frame 12 of tubular material, preferably metal, the frame forming a peripheral support for a tensioned flexible deck 14. The deck membrane 14 is secured to the frame at a series of connection points 16, 18, 20, and 22, via material extending over the frame as shown. At the tail end of the tubular frame 12 (usually of aluminum tubing), the frame is often welded together, but in the snowshoe illustrated the tail ends 24 of the frame are retained together by a tail piece 26, preferably of molded plastic but optionally of other materials, with the deck membrane being secured to the tail piece at 28.

In this type of snowshoe (as in the above referenced patents), a boot binding is suspended by substantially inelastic suspension bands or straps 30 that are secured to the frame and hold the binding at a toe-down bias angle. Here, the binding is not shown, only a carrier plate or base plate 32, with the front cleat and boot binding (not shown) comprising a separate unit and connectable to the carrier plate 32. This forms the subject matter of a co-pending patent application. Under the invention the binding can be either permanently attached or separate.

Figure 2:
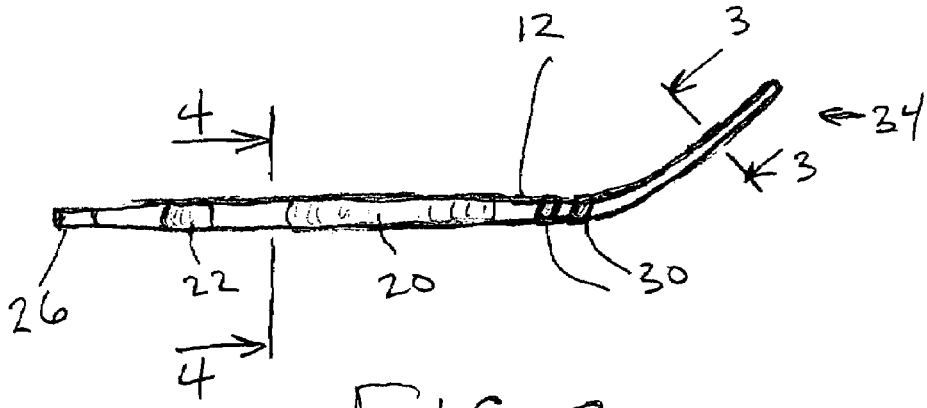
FIG. 2 is a side elevation view of the snowshoe in FIG. 1.
Figure 3:
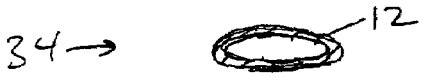
FIG. 3 is a cross sectional view of a portion of the snowshoe frame at one side of the snowshoe, as seen along the line 3-3 in FIG. 2.

As noted above, the binding suspension bands 30 are under considerable tension, which is resisted by the strength of the frame 12, particularly in the front U-shaped portion or nose loop 34 of the frame. If this region of the frame is too weak, it will allow the tension in the bands 30 to relax somewhat, not providing sufficient springing resistance to support the binding properly. Note that the frame aft of this region provides less resistance to inward deformation at the tension bands. For this purpose, pursuant to the invention, the nose loop portion 34 of the tubular frame is formed to a partially flattened or elongated cross sectional configuration, to a cross section which is preferably generally elliptical, as schematically and approximately shown in FIG. 3. FIG. 1 shows that in plan view this nose loop section 34 appears wider due to the partial flattening, and FIG. 2 shows that in profile this area appears thinner. The varying of the cross section of this nominally circular-cylindrical metal tubular frame adds more strength where needed, and enables an overall lighter metal tube to be used, reducing cost and weight of the snowshoe.

Figure 4:
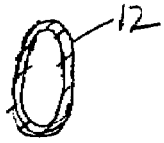
FIG. 4 is a cross sectional view of a portion of the snowshoe frame at one side of the snowshoe, as seen generally along the line 4-4 in FIG. 2.

At the location where the tension bands 30 are connected, the cross section of the frame may be tapering back toward circular, or it can be circular in this area. Behind this region, and behind a portion of the frame that is circular/cylindrical for some distance, the cross section of the metal tube can be partially elongated in cross section in the vertical plane. This adds flexure strength to the snowshoe frame, against bending of the frame when engaging uneven terrain. The taller cross section through this region, almost back to the tail piece 26, is illustrated in FIG. 2. An example of the cross section in this region is also illustrated in FIG. 4. At the tail ends 24 of the snowshoe frame the tubing preferably is again circular, for securing onto the tail piece 26.

Transitions from circular cross section to elongated (and vice versa) are important, especially aesthetically. A smooth transition is important for appearance, and can be achieved with a forming tool. Transitions should be at least 1/2 inch to 1 inch in length. In a preferred embodiment the transition from the elongated nose loop to circular is about 3 inches long; and between the vertically-elongated side sections and the circular region, about 1½ inches.

The following gives one example of dimensions of a snowshoe frame formed in accordance with the invention. The frame can take other dimensions, the numbers below constituting only one example.

Snowshoe length: Approximately 25"

Intended weight range of user: 120 lb. to 250 lb. (preferably 140 lb. to 200 lb.)

Tubing material: aluminum 7075, ¾" O.D., 0.032" wall thickness.

Tubing cross section in nose loop: roughly elliptical, approx. 1.9:1 ratio between larger and smaller outside dimensions More broadly, a ratio for the larger to smaller cross section dimensions can be in the range of about 1.5:1 to about 3:1. At 1.9:1, the nose loop 34 of the frame in a text exhibited about 30% increase in stiffness, where it resists the tension of the bands 30. Snowshoe lengths preferably are in the range of about 21" to about 36", with length depending on the weight of the user. Although aluminum tubing is preferred, primarily for its weight, strength and costs, other metals can be used and molded reinforced plastic tubing could be used if desired, as mentioned above.

Figure 5:
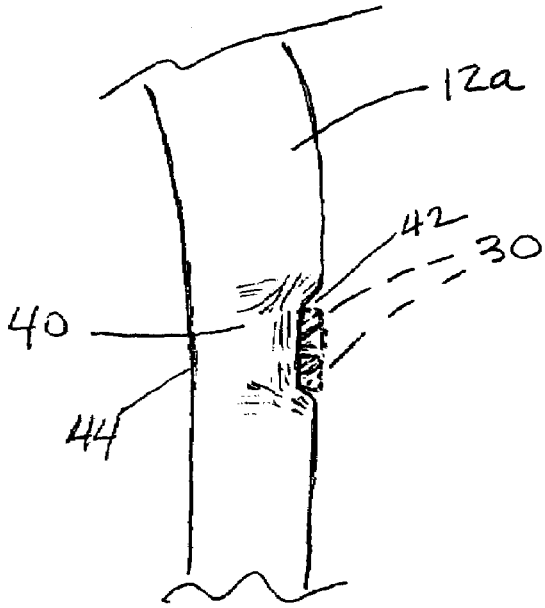
FIG. 5 is a plan view showing a portion of a snowshoe frame with another form of modified tubing cross section.

FIG. 5 shows another feature of the invention, whereby the tensioned straps 30 (dashed lines) are secured around a snowshoe frame 12*a* at a location 40 where the cross section of the frame has been modified in a different way from what is described above. The frame portion is shown in plan view. The tensioned bands 30 that support the boot binding or binding frame or plate 32 on Atlas Snowshoes have typically been wrapped around the frame and riveted into position so as to prevent sliding migration along the frame. Also, by this type of connection the straps 30 extended outwardly from the frame by the thickness of the straps and thus could be subject to abrasion and wear in this area. With the connection arrangement shown in FIG. 5 the frame 12*a* in the region 40 is swaged to form a recess 42 at the outer side of the tubing. With the tubing of malleable aluminum material such as aluminum 7075 or 6061, this swaging step can be performed in the soft, malleable state and virtually any desired cross sectional shape can be achieved in this specific and limited region. Although the tubing could simply be swaged to a band of smaller but concentric diameter, it is somewhat preferable in this instance to maintain the inner wall 44 of the tubing essentially aligned with the inner wall in forward and rear areas, and the swaging of the soft aluminum material can be off-center as shown, placing the recess or inset 42 only where it is needed without causing bulging in the vertical plane.

This shaping operation, and the connection of the bands 30 in this reduced-diameter region at the recess 42, solve both problems of protruding bands and maintaining the location of the bands to prevent migration along the length of the tubing.

Note that the swaging of the tubing to provide recesses can also be performed on the frame at the connection regions 16, 18, 20, and 22 (see FIG. 1) where the suspended deck 14 is secured to the frame, so that the material at these connection points is recessed or flush along the outer edge of the frame or at a selected side of the frame, which could include the outer edge and bottom of the frame where the connecting material engages and. often slides on terrain.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

We claim:

1. A snowshoe having a peripheral frame of tubing, with a flexible deck suspended from and tensioned on the peripheral frame, and the frame comprising:

the tubing of the frame being nominally circular in cross section but elongated in cross section in at least one region of the frame in such a way as to increase bending strength of the frame in a selected plane to resist deformation of the frame from forces acting on the frame during use of the snowshoe.

2. A snowshoe according to claim 1, wherein the snowshoe frame is elongated in cross section in a nose loop region of the frame, with elongation of the cross section of the frame being generally within the plane of the nose loop, such that the snowshoe frame is afforded added strength against inward flexing of the frame near the aft end of the nose loop.

3. A snowshoe according to claim 2, wherein the snowshoe has a binding support secured to the snowshoe frame with a tension band connected to the frame near the aft end of the nose loop, the tension band pulling inwardly on the frame and such inward pulling being resisted by the elongated cross-section frame configuration in the nose loop.

4. A snowshoe according to claim 1, wherein the frame is elongated in cross section along side rails of the frame, aft of a nose loop region, the frame in the side rails being elongated in cross section in a generally vertical direction.

5. A snowshoe according to claim 1, wherein the frame comprises bent and formed metal tubing.

6. A snowshoe according to claim 5, wherein the metal tubing comprises an aluminum material originally malleable but stiffened by heat treating after forming to the elongated cross sectional configuration.

7. A snowshoe according to claim 6, wherein the metal is aluminum 7075 or 6061.

8. A snowshoe according to claim 5, wherein the elongation of the cross section of the frame is at a ratio of about 1.5:1 to 3:1 between an elongated outer dimension and a smaller outer dimension.

9. A snowshoe according to claim 8, wherein the elongation ratio is approximately 1.9:1.

10. A snowshoe according to claim 5, wherein the tubing has a nominal circular outer diameter of about 0.75".

11. A snowshoe according to claim 5, wherein the frame is elongated in cross section in a nose loop region of the frame, with elongation being generally within the plane of the nose loop, and the elongation being such that the stiffness of the nose loop within the plane of the nose loop is increased by about thirty percent.

12. A snowshoe having a peripheral frame of bent and formed metal tubing, with a flexible deck suspended from and tensioned on the peripheral frame, and comprising:

the tubing of the frame being nominally round in cross section but swaged in selected regions to deform the metal tubing to form a smaller peripheral dimension in such regions and to form, at a selected side of the tubing, a recess at such selected regions, and connections securing the tensioned deck on the frame, comprising flexible connecting material extending over the frame tubing in the recesses at said selected regions so that the connecting material does not protrude outwardly from the frame.

13. A snowshoe according to claim 12, wherein the metal tubing is an aluminum material originally malleable but heat-treated after swaging of the selected regions.

14. A snowshoe according to claim 13, wherein the aluminum material comprises aluminum 7075 or 6061.

15. A snowshoe having a peripheral frame of bent and formed metal tubing, with a flexible deck suspended from and tensioned on the peripheral frame, and the snowshoe including a binding support secured to the snowshoe frame with a tension band connected to the frame near the aft end of a nose loop of the frame, and comprising:

the tubing of the frame being nominally round in cross section but swaged in selected regions of the frame to deform the metal tubing so as to form, at an outer side of the frame, a recess at such selected regions, such regions being where the tension band is connected to the frame, the tension band being wrapped around the frame and positioned in the recesses so that the tension band does not protrude outwardly from the frame.

16. A snowshoe according to claim 15, wherein the tubing of the frame is elongated in cross section in at least one region of the frame in such a way as to increase bending strength of the frame in a selected plane to resist deformation of the frame from forces acting on the frame during use of the snowshoe.

17. A snowshoe according to claim 16, wherein the snowshoe frame is elongated in cross section in the nose loop region of the frame, with elongation of the cross section of the frame being generally within the plane of the nose loop, such that the snowshoe frame is afforded added strength against inward flexing of the frame under the force of the tension band, near the aft end of the nose loop.

* * * * *

UNITED STATES PATENT AND TRADEMARK OFFICE

CERTIFICATE OF CORRECTION

PATENT NO. : 7,331,129 B1
APPLICATION NO. : 11/207693
DATED : February 19, 2008
INVENTOR(S) : Peter W. Chapman and Daniel T. Emerson It is certified that error appears in the above-identified patent and that said Letters Patent is hereby corrected as shown below:

On the Title Page Item (73) should read

-- K2 Snowshoes, Inc. --.

Signed and Sealed this

Tenth Day of June, 2008

JON W. DUDAS
*Director of the United States Patent and Trademark Office*